US007131817B2

(12) United States Patent
Keith et al.

(10) Patent No.: US 7,131,817 B2
(45) Date of Patent: Nov. 7, 2006

(54) METHOD AND APPARATUS FOR COOLING GAS TURBINE ENGINE ROTOR BLADES

(75) Inventors: Sean Robert Keith, Fairfield, OH (US); Michael Joseph Danowski, Cincinnati, OH (US); Leslie Eugene Leeke, Jr., Burlington, KY (US)

(73) Assignee: General Electric Company, Schenectady, NY (US)

( * ) Notice: Subject to any disclaimer, the term of this patent is extended or adjusted under 35 U.S.C. 154(b) by 137 days.

(21) Appl. No.: 10/903,634

(22) Filed: Jul. 30, 2004

(65) Prior Publication Data

US 2006/0024164 A1 Feb. 2, 2006

(51) Int. Cl.
*F01D 5/08* (2006.01)
*B21D 53/78* (2006.01)

(52) U.S. Cl. ..... 416/97 R; 416/193 A; 415/115; 29/889.72

(58) Field of Classification Search ..... 415/115; 416/95, 97 A, 97 R, 193 A; 29/889.7, 889.72, 29/889.721
See application file for complete search history.

(56) References Cited

U.S. PATENT DOCUMENTS 2,656,147 A * 10/1953 Denison et al. ..... 416/97 R
3,814,539 A * 6/1974 Klompas ..... 416/95
4,604,031 A 8/1986 Moss et al.
4,940,388 A 7/1990 Lilleker et al.
5,382,135 A 1/1995 Green
5,387,085 A * 2/1995 Thomas et al. ..... 416/97 R
5,639,216 A 6/1997 McLaurin et al.
5,848,876 A 12/1998 Tomita
5,915,923 A * 6/1999 Tomita et al. ..... 416/96 R
6,079,946 A 6/2000 Suenaga et al.
6,092,991 A 7/2000 Tomita et al.
6,120,249 A 9/2000 Hultgren et al.
6,132,173 A 10/2000 Tomita et al.
6,190,130 B1 * 2/2001 Fukue et al. ..... 416/97 R
6,196,799 B1 3/2001 Fukue et al.
6,210,111 B1 4/2001 Liang
6,227,804 B1 5/2001 Koga et al.
6,254,345 B1 7/2001 Harris et al.
6,402,471 B1 * 6/2002 Demers et al. ..... 416/97 R
6,416,284 B1 7/2002 Demers et al.
6,422,811 B1 7/2002 Beeck et al.
6,478,540 B1 * 11/2002 Abuaf et al. ..... 416/1
6,508,620 B1 1/2003 Sreekanth et al.
6,619,912 B1 9/2003 Tiemann
6,641,360 B1 11/2003 Beeck et al.
6,644,920 B1 11/2003 Beeck et al.
6,719,529 B1 4/2004 Tiemann

* cited by examiner

*Primary Examiner*—Igor Kershteyn
(74) *Attorney, Agent, or Firm*—William Scott Andes; Armstrong Teasdale LLP

(57) ABSTRACT

A method for fabricating a rotor blade includes casting the turbine rotor blade to include a shank, and a platform having an upper surface and a lower surface, and coupling a first component to the rotor blade such that a first substantially hollow plenum is defined between the first component, the shank, and the platform lower surface.

20 Claims, 6 Drawing Sheets

METHOD AND APPARATUS FOR COOLING GAS TURBINE ENGINE ROTOR BLADES

BACKGROUND OF THE INVENTION

This application relates generally to gas turbine engines and, more particularly, to methods and apparatus for cooling gas turbine engine rotor blades.

At least some known rotor assemblies include at least one row of circumferentially-spaced rotor blades. Each rotor blade includes an airfoil that includes a pressure side, and a suction side connected together at leading and trailing edges. Each airfoil extends radially outward from a rotor blade platform to a tip, and also includes a dovetail that extends radially inward from a shank extending between the platform and the dovetail. The dovetail is used to couple the rotor blade within the rotor assembly to a rotor disk or spool. At least some known rotor blades are hollow such that an internal cooling cavity is defined at least partially by the airfoil, through the platform, the shank, and the dovetail.

During operation, because the airfoil portion of each blade is exposed to higher temperatures than the dovetail portion, temperature gradients may develop at the interface between the airfoil and the platform, and/or between the shank and the platform. Over time, thermal strain generated by such temperature gradients may induce compressive thermal stresses to the blade platform. Moreover, over time, the increased operating temperature of the platform may cause platform oxidation, platform cracking, and/or platform creep deflection, which may shorten the useful life of the rotor blade.

To facilitate reducing the effects of the high temperatures in the platform region, shank cavity air and/or a mixture of blade cooling air and shank cavity air is introduced into a region below the platform region to facilitate cooling the platform. However, in at least some known turbines, the shank cavity air is significantly warmer than the blade cooling air. Moreover, because the platform cooling holes are not accessible to each region of the platform, the cooling air may not be provided uniformly to all regions of the platform to facilitate reducing an operating temperature of the platform region.

BRIEF SUMMARY OF THE INVENTION

In one aspect, a method for fabricating a rotor blade is provided. The method includes casting the turbine rotor blade to include a shank, and a platform having an upper surface and a lower surface, and coupling a first component to the rotor blade such that a first substantially hollow plenum is defined between the first component, the shank, and the platform lower surface.

In another aspect, a turbine rotor blade is provided. The rotor blade includes a shank, a platform coupled to the shank, the platform comprising an upper surface and a lower surface, a first component coupled to the rotor blade such that a first substantially hollow plenum is defined between the first component, the shank, and the platform lower surface; and an airfoil coupled to the platform.

In a further aspect, a gas turbine engine is provided. The gas turbine engine includes a turbine rotor, and a plurality of circumferentially-spaced rotor blades coupled to the turbine rotor, wherein each rotor blade includes a shank, a platform including an upper and lower surface coupled to the shank, a first component coupled to the platform lower surface and the shank such that a first substantially hollow plenum is defined between the first component, the shank, and the platform lower surface, and an airfoil coupled to the platform.

DETAILED DESCRIPTION OF THE INVENTION

Figure 1:
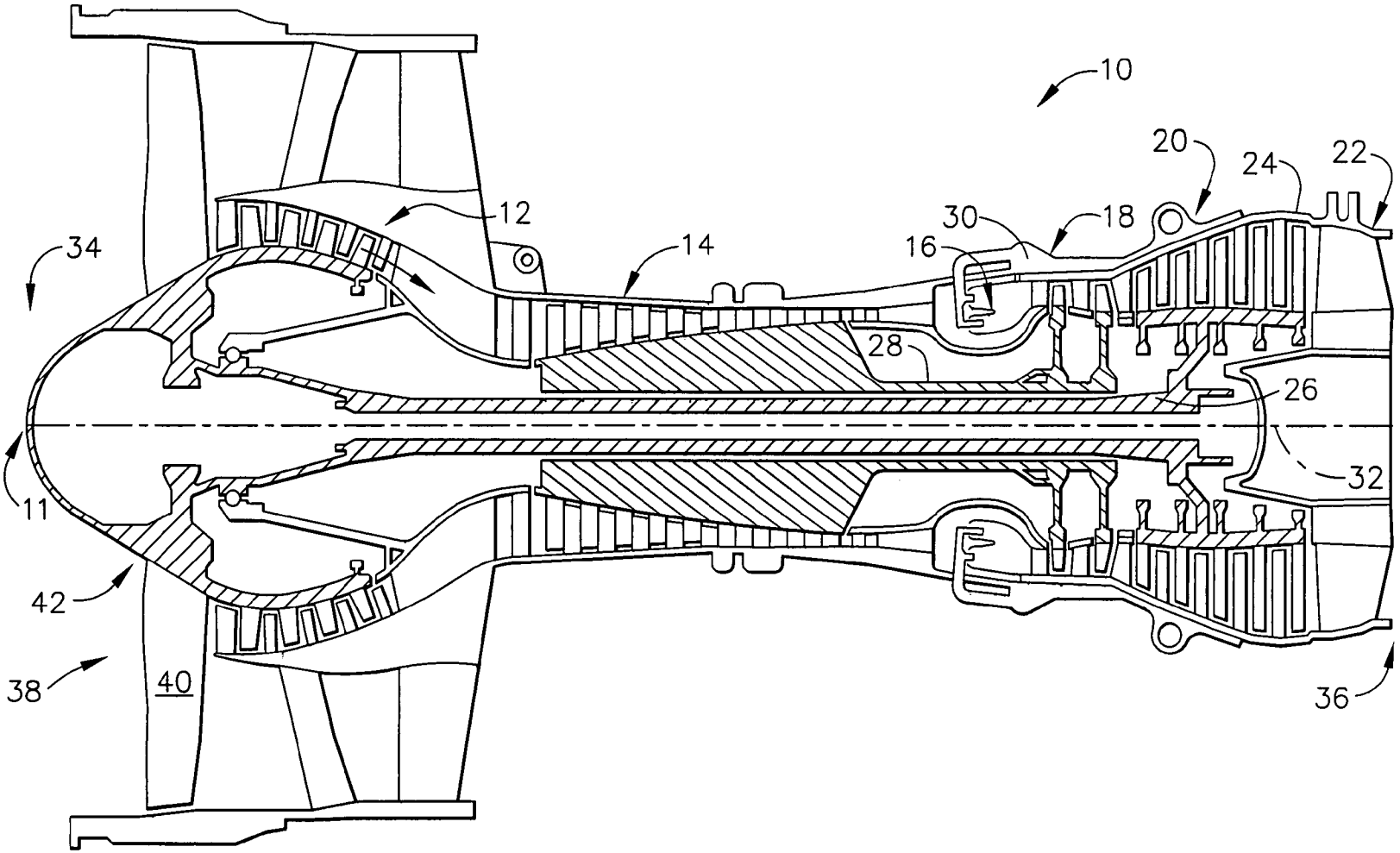
FIG. 1 is a schematic illustration of an exemplary gas turbine engine.

FIG. 1 is a schematic illustration of an exemplary gas turbine engine 10 including a rotor 11 that includes a low-pressure compressor 12, a high-pressure compressor 14, and a combustor 16. Engine 10 also includes a high-pressure turbine (HPT) 18, a low-pressure turbine 20, an exhaust frame 22 and a casing 24. A first shaft 26 couples low-pressure compressor 12 and low-pressure turbine 20, and a second shaft 28 couples high-pressure compressor 14 and high-pressure turbine 18. Engine 10 has an axis of symmetry 32 extending from an upstream side 34 of engine 10 aft to a downstream side 36 of engine 10. Rotor 11 also includes a fan 38, which includes at least one row of airfoil-shaped fan blades 40 attached to a hub member or disk 42. In one embodiment, gas turbine engine 10 is a GE90 engine commercially available from General Electric Company, Cincinnati, Ohio.

In operation, air flows through low-pressure compressor 12 and compressed air is supplied to high-pressure compressor 14. Highly compressed air is delivered to combustor 16. Combustion gases from combustor 16 propel turbines 18 and 20. High pressure turbine 18 rotates second shaft 28 and high pressure compressor 14, while low pressure turbine 20 rotates first shaft 26 and low pressure compressor 12 about axis 32. During some engine operations, a high pressure turbine blade may be subjected to a relatively large thermal gradient through the platform, i.e. (hot on top, cool on the bottom) causing relatively high tensile stresses at a trailing edge root of the airfoil which may result in a mechanical failure of the high pressure turbine blade. Improved platform cooling facilitates reducing the thermal gradient and therefore reduces the trailing edge stresses. Rotor blades may also experience concave platform cracking and bowing from creep deformation due to the high platform temperatures. Improved platform cooling described herein facilitates reducing these distress modes as well.

Figure 2:
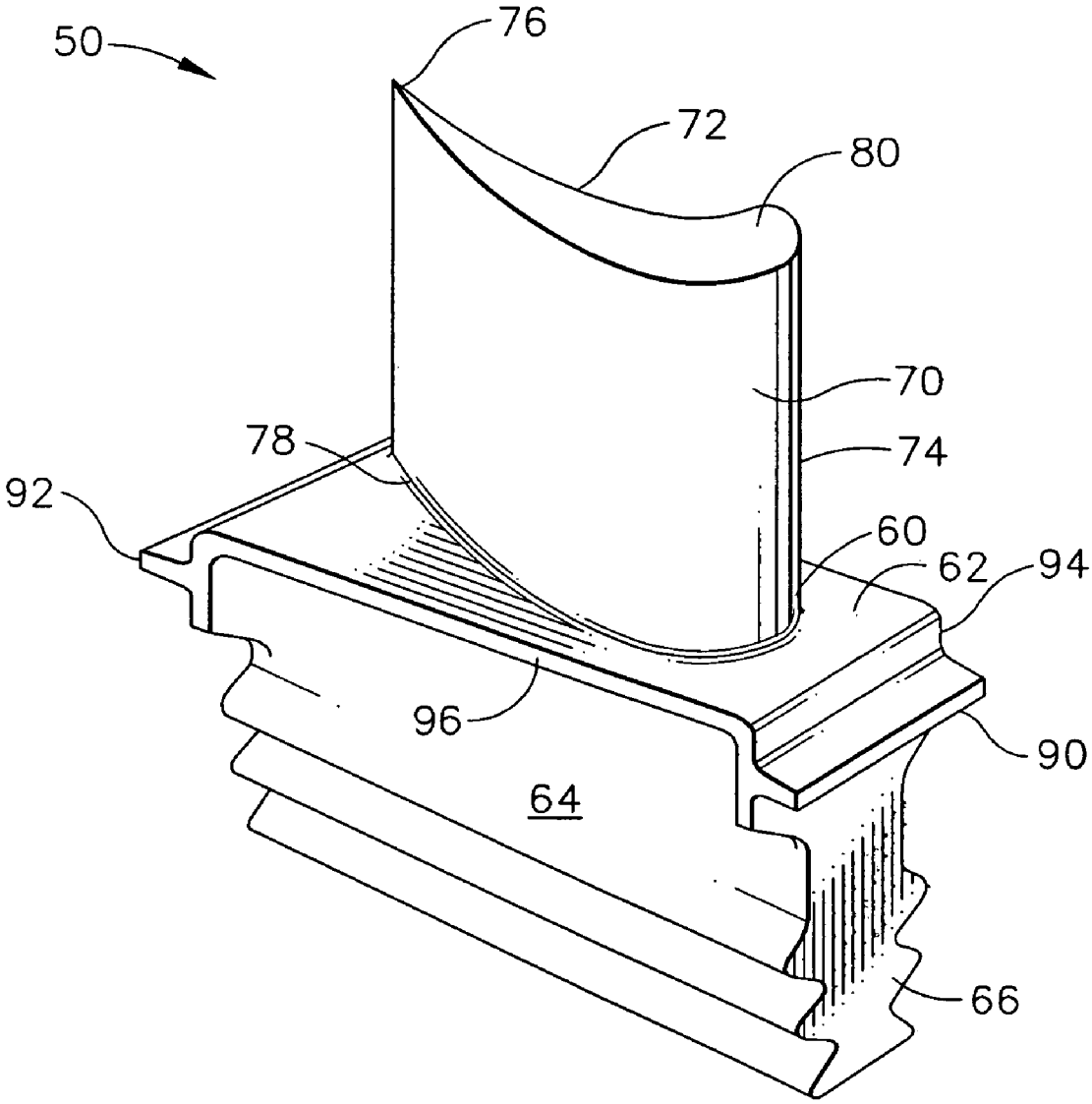
FIG. 2 is an enlarged perspective view of an exemplary rotor blade that may be used with the gas turbine engine shown in FIG. 1.

FIG. 2 is an enlarged perspective view of a turbine rotor blade 50 that may be used with gas turbine engine 10 (shown in FIG. 1). In the exemplary embodiment, blade 50 has been modified to include the features described herein. When coupled within the rotor assembly, each rotor blade 50 is coupled to a rotor disk 30 that is rotatably coupled to a rotor shaft, such as shaft 26 (shown in FIG. 1). In an alternative embodiment, blades 50 are mounted within a rotor spool (not shown). In the exemplary embodiment, circumferentially adjacent rotor blades 50 are identical and each extends radially outward from rotor disk 30 and includes an airfoil 60, a platform 62, a shank 64, and a dovetail 66 formed integrally with shank 64. In the exemplary embodiment, airfoil 60, platform 62, shank 64, and dovetail 66 are collectively known as a bucket.

Each airfoil 60 includes a first sidewall 70 and a second sidewall 72. First sidewall 70 is convex and defines a suction side of airfoil 60, and second sidewall 72 is concave and defines a pressure side of airfoil 60. Sidewalls 70 and 72 are joined together at a leading edge 74 and at an axially-spaced trailing edge 76 of airfoil 60. More specifically, airfoil trailing edge 76 is spaced chord-wise and downstream from airfoil leading edge 74.

First and second sidewalls 70 and 72, respectively, extend longitudinally or radially outward in span from a blade root 78 positioned adjacent platform 62, to an airfoil tip 80. Airfoil tip 80 defines a radially outer boundary of an internal cooling chamber (not shown) that is defined within blades 50. More specifically, the internal cooling chamber is bounded within airfoil 60 between sidewalls 70 and 72, and extends through platform 62 and through shank 64 to facilitate cooling airfoil 60.

Platform 62 extends between airfoil 60 and shank 64 such that each airfoil 60 extends radially outward from each respective platform 62. Shank 64 extends radially inwardly from platform 62 to dovetail 66, and dovetail 66 extends radially inwardly from shank 64 to facilitate securing rotor blades 50 to rotor disk 30. Platform 62 also includes an upstream side or skirt 90 and a downstream side or skirt 92 that are connected together with a pressure-side edge 94 and an opposite suction-side edge 96.

Figure 3:
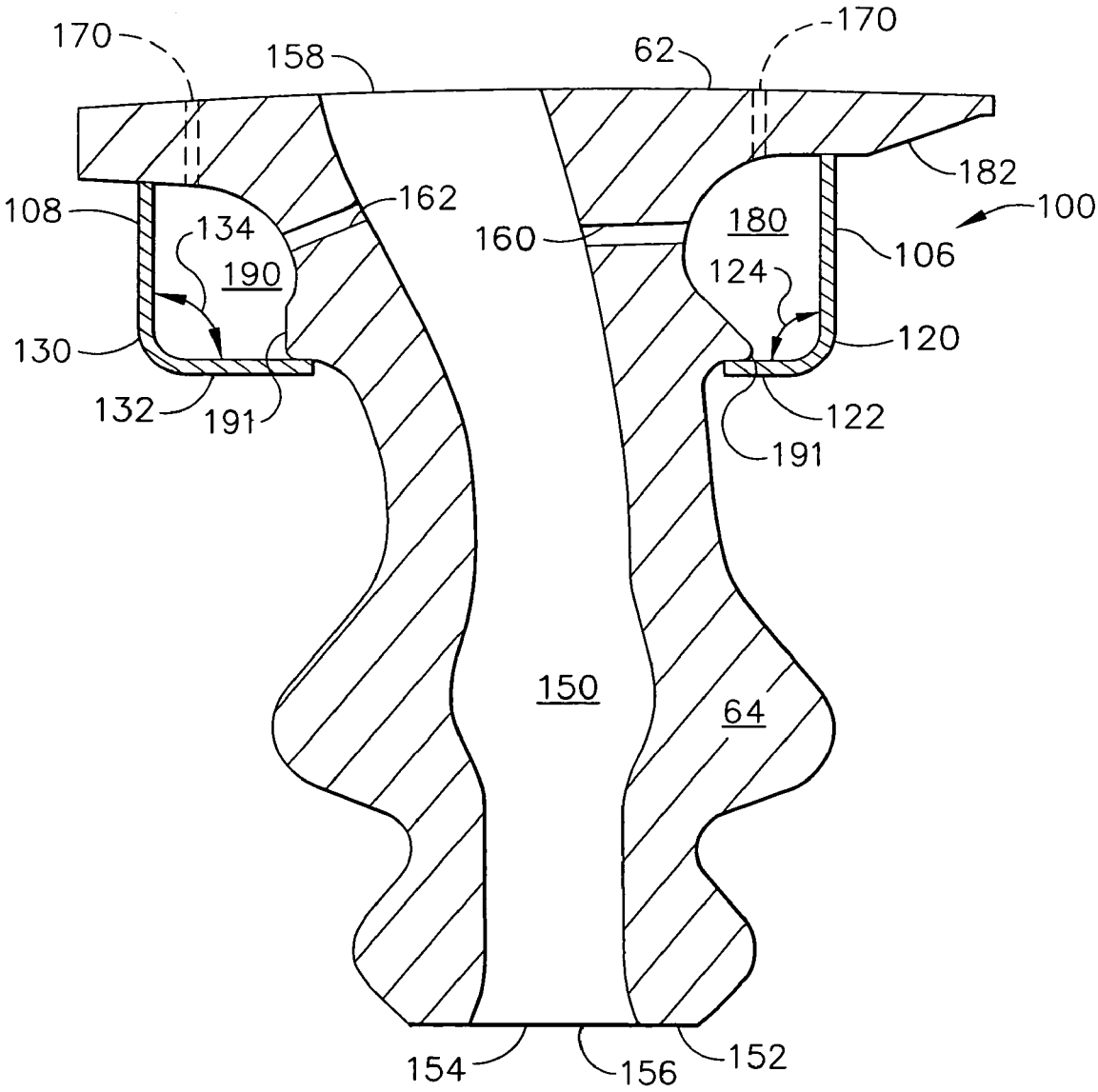
FIG. 3 is a cross-sectional view of a portion of the rotor blade shown in FIG. 2 including an exemplary brazed-on plenum.
Figure 4:
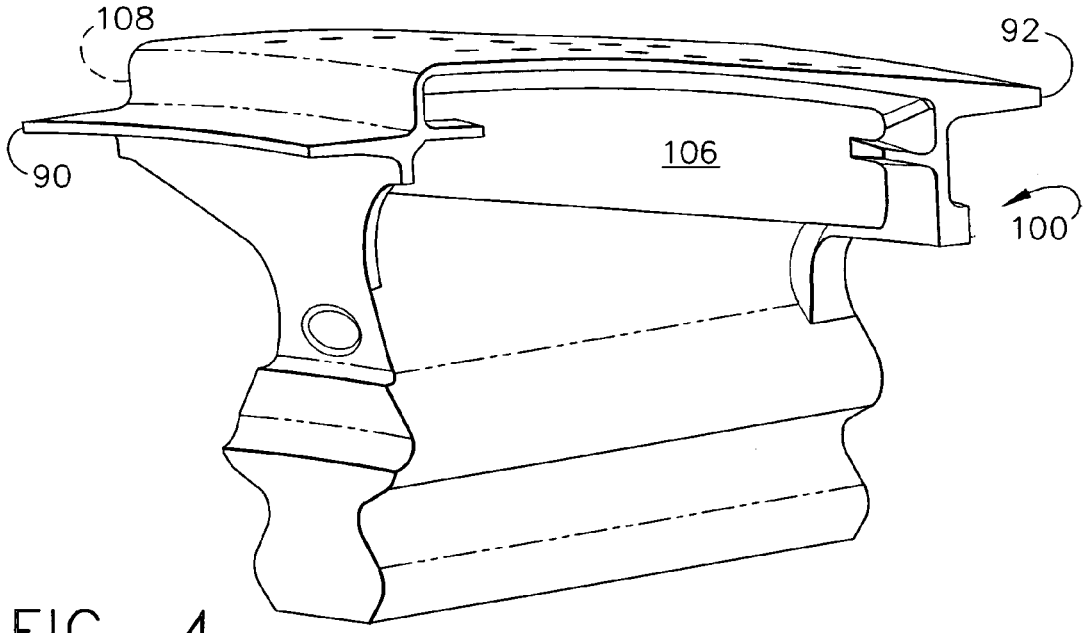
FIG. 4 is a side perspective view of the turbine rotor blade shown in FIG. 3.
Figure 5:
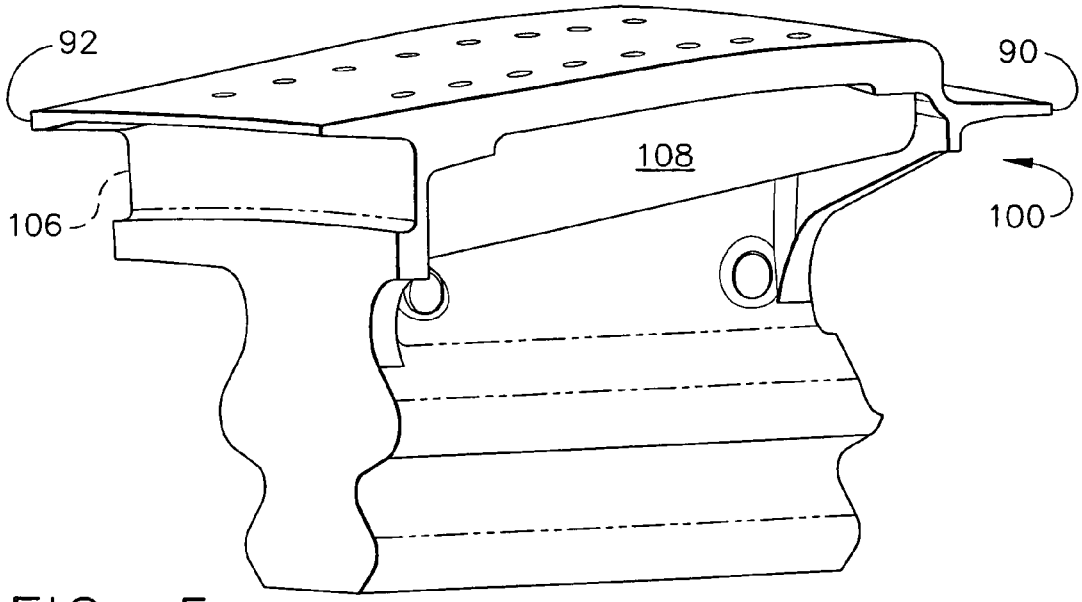
FIG. 5 is a top perspective view of the turbine rotor blade shown in FIG. 3.
Figure 6:
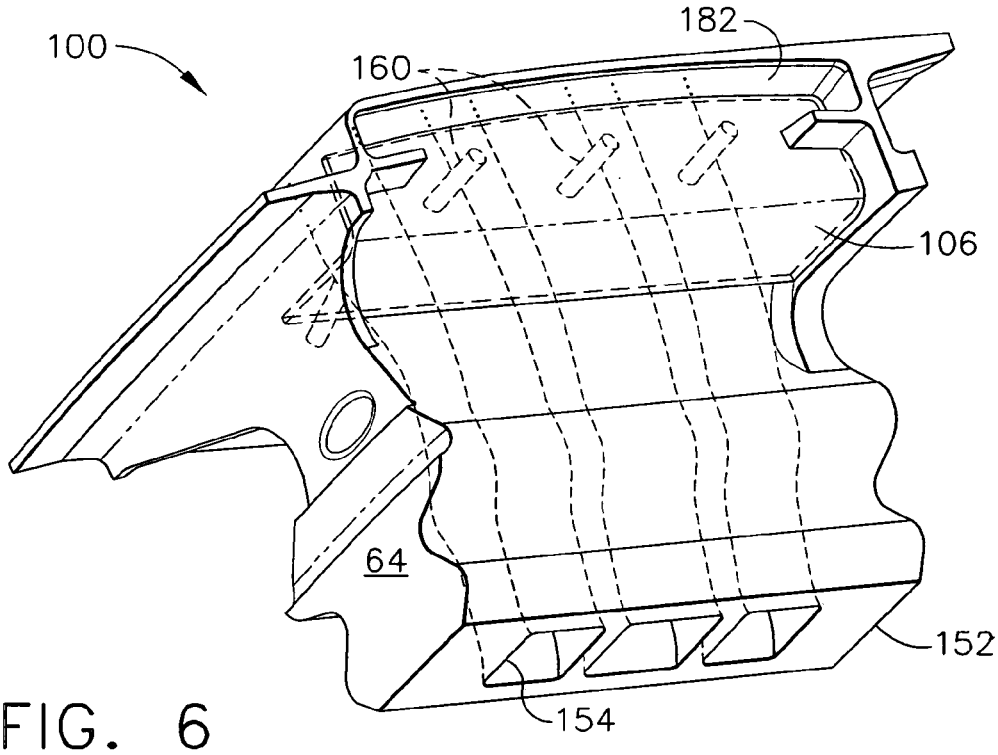
FIG. 6 is a bottom perspective view of the turbine rotor blade shown in FIG. 3.
Figure 7:
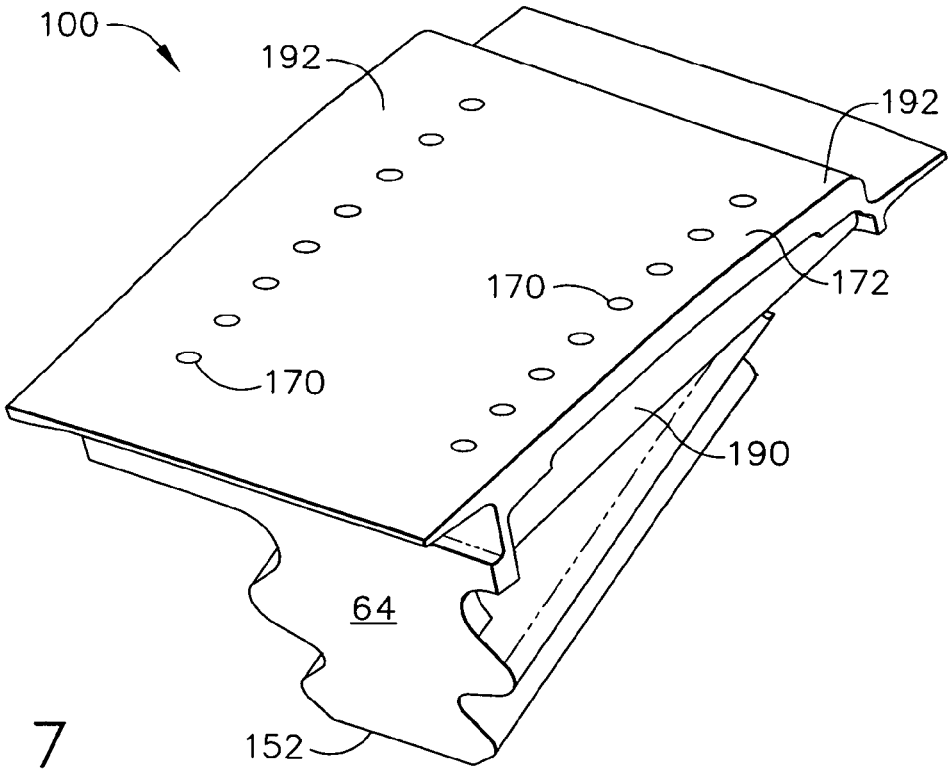
FIG. 7 is a top perspective view of a portion of the turbine rotor blade shown in FIG. 3.

FIG. 3 is a cross-sectional view of a portion of turbine rotor blade 50 shown in FIG. 2 including an exemplary brazed-on plenum 100. FIG. 4 is a first side perspective view of turbine rotor blade 50 shown in FIG. 3. FIG. 5 is a second side perspective view of turbine rotor blade 50 shown in FIG. 3. FIG. 6 is a bottom perspective view of turbine rotor blade 50 shown in FIG. 3. FIG. 7 is a top perspective view of a portion of turbine rotor blade 50 shown in FIG. 3.

Brazed-on plenum 100 includes a first plenum portion 106 and a second plenum portion 108. First plenum portion 106 includes a first side 120 and a second side 122 that is coupled to first side 120 such that an angle 124 is defined between first and second sides 120 and 122 respectively. In the exemplary embodiment, angle 124 is approximately 90°. Second plenum portion 108 includes a first side 130 and a second side 132 coupled to first side 130 such that an angle 134 is defined between first and second sides 130 and 132 respectively. In the exemplary embodiment, angle 134 is approximately 90°. In the exemplary embodiment, first plenum portion 106 and second plenum portion 108 are fabricated from a metallic material.

Turbine rotor blade 50 also includes a first channel 150 that extends from a lower surface 152 of shank 64 to brazed-on plenum 100. More specifically, first channel 150 includes an opening 154 that extends through shank 64 such that lower surface 152 is coupled in flow communication with brazed-on plenum 100. Channel 150 includes a first end 156 and a second end 158. In the exemplary embodiment, turbine rotor blade 50 also includes a first shank opening 160 and a second shank opening 162 that each extend between first channel 150 and respective first and second portions 106 and 108. Accordingly, first channel 150, and first and second portions 106 and 108 are coupled in flow communication. More specifically, first shank opening 160 is coupled in flow communication with first channel 150 and first portion 106, and second shank opening 162 is coupled in flow communication with first channel 150 and second portion 108.

Turbine rotor blade 50 also includes a plurality of openings 170 in flow communication with brazed-on plenum 100 and extending between brazed-on plenum 100 and a platform upper surface 172. Openings 170 facilitate cooling platform 62. In the exemplary embodiment, openings 170 extend between brazed-on plenum first and second portions 106 and 108 and platform upper surface 172. In the exemplary embodiment, openings 170 are sized to enable a predetermined amount of cooling airflow to be discharged therethrough to facilitate cooling platform 62.

During fabrication of brazed-on plenum 100, a core (not shown) is cast into turbine blade 50. The core is fabricated by injecting a liquid ceramic and graphite slurry into a core die (not shown). The slurry is heated to form a solid ceramic plenum core. The core is suspended in an turbine blade die (not shown) and hot wax is injected into the turbine blade die to surround the ceramic core. The hot wax solidifies and forms a turbine blade with the ceramic core suspended in the blade platform. The wax turbine blade with the ceramic core is then dipped in a ceramic slurry and allowed to dry. This procedure is repeated several times such that a shell is formed over the wax turbine blade. The wax is then melted out of the shell leaving a mold with a core suspended inside, and into which molten metal is poured. After the metal has solidified the shell is broken away and the core removed to form first shank opening 160, second shank opening 162, and at least one first channel 150. In an alternative embodiment, one or all of first shank opening 160, second shank opening 162, and at least one first channel 150 may be formed by drilling.

First plenum portion 106 and second plenum portion 108 are then coupled to an outer periphery of turbine blade 50. More specifically, first plenum portion 106 is coupled to turbine blade 50 such that a substantially hollow plenum 180, having a substantially rectangular cross-sectional profile, is formed on a platform lower surface 182. More specifically, first plenum portion 106 is coupled to platform 62 and shank 64 such that first side 120, second side 122, platform lower surface 182, and shank 64 define plenum 180. Second plenum portion 108 is coupled to turbine blade 50 such that a hollow plenum 190 having a substantially rectangular cross-sectional profile is formed on platform lower surface 182. More specifically, second plenum portion 108 is coupled to platform 62 and shank 64 such that first side 130, second side 132, platform lower surface 182, and shank 64 define plenum 190. In the exemplary embodiment, first and second plenum portions 106 and 108 are brazed to platform lower surface 182 and shank 64. In another exemplary embodiment, first and second plenum portions 106 and 108 are coupled to platform lower surface 182 and shank 64 using lugs 191 for example, and then tack-welded to platform lower surface 182 and shank 64.

During engine operation, cooling air entering channel first end 156 is channeled through first channel 150 and discharged through first and second shank openings 160 and 162 and into first and second plenum portions 106 and 108 respectively. The cooling air is then channeled from first and second plenum portions 180 and 190 through openings 170 and around platform upper surface 172 to facilitate reducing an operating temperature of platform 62. Moreover, the cooling air discharged from openings 170 facilitates reducing thermal strains induced to platform 62. Openings 170 are selectively positioned around an outer periphery 192 of platform 62 to facilitate cooling air being channeled towards predetermined areas of platform 62 to facilitate cooling platform 62. Accordingly, when rotor blades 50 are coupled within the rotor assembly, channel 150 enables compressor discharge air to flow into brazed-on plenum 100 and through openings 170 to facilitate reducing an operating temperature of platform 62.

Figure 8:
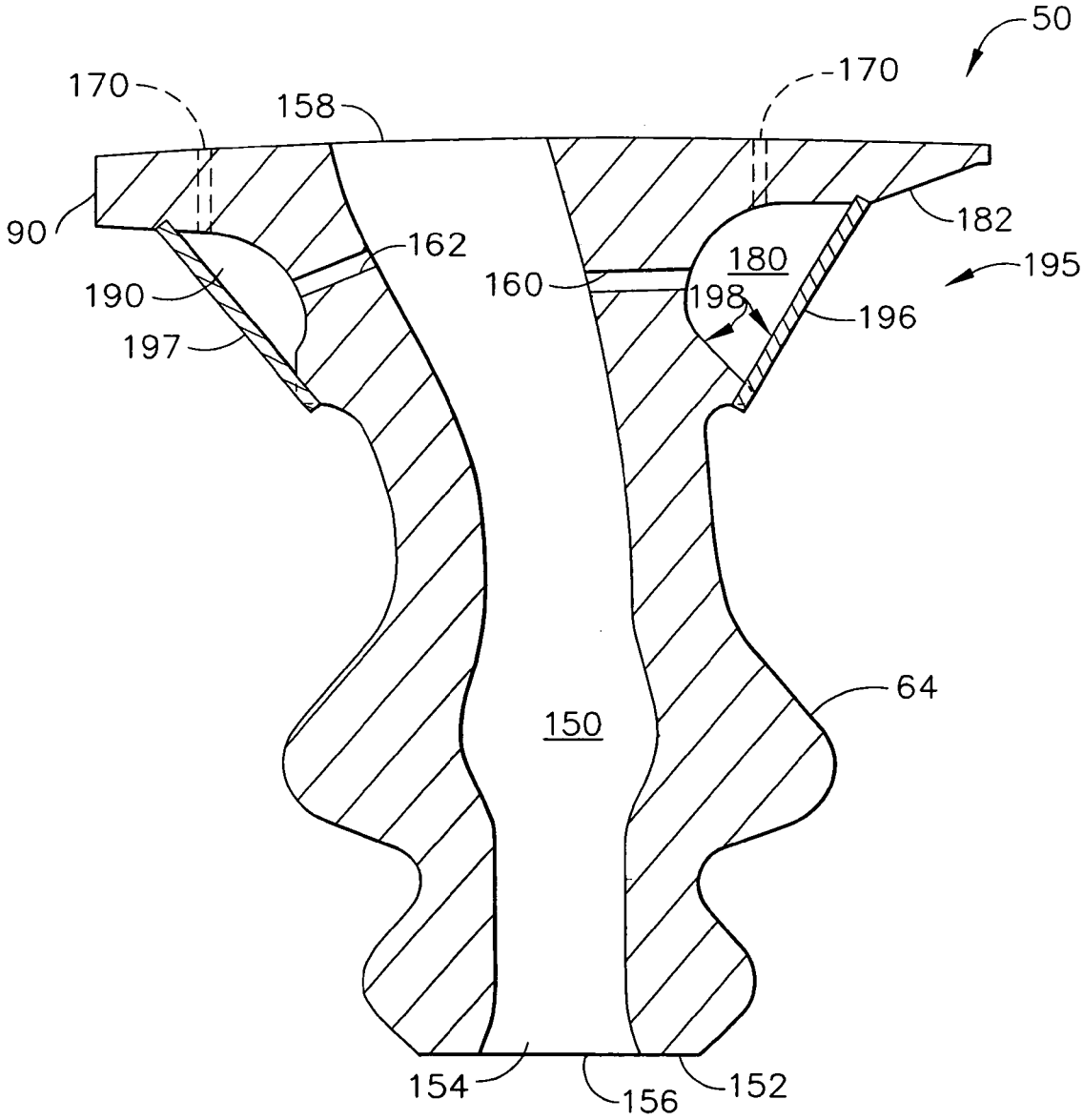
FIG. 8 is a perspective view of an alternative embodiment of the brazed-on plenum shown in FIG. 3.

FIG. 8 is a cross-sectional view of a portion of turbine rotor blade 50 shown in FIG. 2 including an exemplary brazed-on plenum 195. Brazed-on plenum 195 is substantially similar to brazed-on plenum 100, (shown in FIGS. 3–7) and components of plenum 195 that are identical to components of plenum 100 are identified in FIG. 8 using the same reference numerals used in FIGS. 3–7.

Brazed-on plenum 195 includes at least a first plenum portion 196. In an alternative embodiment, brazed-on plenum 195 includes a second plenum portion 197. First and second plenum portions 196 and 197 are unitary components that are coupled to shank 64 such that an angle 198 is defined between first and second plenum portions 196 and 197, shank 64, and platform lower surface 182, and such that substantially hollow first plenum and second plenums 180 and 190 are defined between first and second plenum portions 196 and 197, shank 64, and platform lower surface 182. In the exemplary embodiment, angle 198 is approximately 45°.

Turbine rotor blade 50 also includes first channel 150 that extends from a lower surface 152 of shank 64 to brazed-on plenum 195. More specifically, first channel 150 includes opening 154 that extends through shank 64 such that lower surface 152 is coupled in flow communication with brazed-on plenum 195. Channel 150 includes first end 156 and second end 158. In the exemplary embodiment, turbine rotor blade 50 also includes first shank opening 160 and second shank opening 162 (shown in FIG. 3) that each extend between first channel 150 and respective first and second portions 106 and 108. Accordingly, first channel 150, and first and second portions 106 and 108 are coupled in flow communication. More specifically, first shank opening 160 is coupled in flow communication with first channel 150 and first plenum 180, and second shank opening 162 is coupled in flow communication with first channel 150 and second plenum 190.

Turbine rotor blade 50 also includes a plurality of openings 170 in flow communication with brazed-on plenum 195 and extending between first plenum 180 and platform upper surface 172, and extending between second plenum 190 and platform upper surface 172. Openings 170 facilitate cooling platform 62 and are sized to enable a predetermined amount of cooling airflow to be discharged therethrough to facilitate cooling platform 62.

The above-described rotor blades provide a cost-effective and reliable method for supplying cooling air to facilitate reducing an operating temperature of the rotor blade platform. More specifically, through cooling flow, thermal stresses induced within the platform, and the operating temperature of the platform is facilitated to be reduced. Accordingly, platform oxidation, platform cracking, and platform creep deflection is also facilitated to be reduced. As a result, the rotor blade cooling brazed-on plenums facilitate extending a useful life of the rotor blades and improving the operating efficiency of the gas turbine engine in a cost-effective and reliable manner. Moreover, the method and apparatus described herein facilitate stabilizing platform hole cooling flow levels because the air is provided directly to the brazed-on plenum via a dedicated channel, rather than relying on secondary airflows and/or leakages to facilitate cooling platform 62. Accordingly, the method and apparatus described herein facilitates eliminating the need for fabricating shank holes in the rotor blade.

Exemplary embodiments of rotor blades and rotor assemblies are described above in detail. The rotor blades are not limited to the specific embodiments described herein, but rather, components of each rotor blade may be utilized independently and separately from other components described herein. For example, each rotor blade cooling circuit component can also be used in combination with other rotor blades, and is not limited to practice with only rotor blade 50 as described herein. Rather, the present invention can be implemented and utilized in connection with many other blade and cooling circuit configurations. For example, the methods and apparatus can be equally applied to rotor vanes such as, but not limited to an HPT vanes.

While the invention has been described in terms of various specific embodiments, those skilled in the art will recognize that the invention can be practiced with modification within the spirit and scope of the claims.

What is claimed is:

1. A method for fabricating a rotor blade, said method comprising:

casting the rotor blade to include a shank having at least one channel defined therethrough, and a platform having an upper surface and a lower surface;

coupling a first component to the rotor blade such that a substantially hollow first plenum is defined between the first component and the shank and the platform lower surface; and forming a first plurality of openings extending between the first plenum and the platform upper surface, such that air discharged from the at least one channel into the first plenum flows through the first plurality of openings to facilitate cooling the platform upper surface.

2. A method in accordance with claim 1 further comprising:

coupling a second component to the rotor blade such that a substantially hollow second plenum is defined between the second component and the shank and the platform lower surface; and forming a second plurality of openings extending between the second plenum and the platform upper surface.

3. A method in accordance with claim 2 wherein casting a rotor blade further comprises sizing the first and second plurality of openings to facilitate controlling a quantity of cooling air supplied to the platform upper surface.

4. A method in accordance with claim 2 wherein casting a rotor blade further comprises extending the at least one channel between a shank lower surface and at least one of the first and second plenums.

5. A method in accordance with claim 2 wherein casting a rotor blade further comprises casting a rotor blade that includes at least one first shank opening extending between the channel and the first plenum, and at least one second shank opening extending between the channel and the second plenum.

6. A method in accordance with claim 5 wherein casting a rotor blade further comprises casting a rotor blade that includes a plurality of channels extending between a shank lower surface and the first and second shank openings.

7. A method in accordance with claim 2 wherein coupling the plenum first and second components to the rotor blade comprises brazing the first and second components to a turbine rotor blade.

8. A rotor blade comprising:

a shank comprising at least one channel defined therethrough;

a platform coupled to said shank, said platform comprising an upper surface and a lower surface;

a component coupled to said rotor blade such that a first substantially hollow plenum is defined between said first component and said shank and said platform lower surface;

a first plurality of openings extending between said first plenum and said platform upper surface, such that air discharged from said at least one channel into said first plenum flows through said first plurality of openings to facilitate cooling said platform upper surface; and an airfoil coupled to said platform.

9. A rotor blade in accordance with claim 8 wherein said rotor blade further comprises:

a second component brazed to said rotor blade such that a second substantially hollow plenum is defined between said second component and said shank and said platform lower surface, and such that said at least one channel extends in flow communication between said first and second plenums; and a second plurality of openings extending between said second plenum and said platform upper surface.

10. A rotor blade in accordance with claim 9 wherein said first and said second plurality of openings are sized to facilitate controlling a quantity of cooling air supplied to the platform upper surface.

11. A rotor blade in accordance with claim 9 further comprising at least one first shank opening extending between said channel and said first plenum, and at least one second shank opening extending between said channel and said second plenum.

12. A rotor blade in accordance with claim 11 further comprising exactly three channels extending between said a shank lower surface and said at least one first and second shank openings.

13. A rotor blade in accordance with claim 9 wherein said first and second plenums are brazed to said platform lower surface and said shank.

14. A rotor blade in accordance with claim 8 wherein said rotor blade further comprises a second component brazed to said rotor blade such that a second substantially hollow plenum is defined between said second component and said shank and said platform lower surface, and such that a plurality of channels are coupled in flow communication with said first plenum and a shank lower surface, and said second plenum and said shank lower surface.

15. A gas turbine engine rotor assembly comprising:

a rotor; and a plurality of circumferentially-spaced rotor blades coupled to said rotor, at least one of said plurality of rotor blades comprises a shank having at least one channel defined therethrough, a platform comprising an upper and lower surface coupled to said shank, a first component coupled to said platform lower surface and said shank such that a first substantially hollow plenum is defined between said first component and said shank and said platform lower surface, and a first plurality of openings extending between said first plenum and said platform upper surface, such that air discharged from said at least one channel into said first plenum flows through said first plurality of openings to facilitate cooling said platform upper surface.

16. A gas turbine engine rotor assembly in accordance with claim 15 wherein said rotor blade further comprises:

a second component coupled to said platform lower surface and said shank such that a second substantially hollow plenum is defined between said second component and said shank and said platform lower surface; and a second plurality of openings extending between said second plenum and said platform upper surface.

17. A gas turbine engine rotor assembly in accordance with claim 16 wherein said at least one channel is coupled in flow communication with a shank lower surface and said first and second plenums.

18. A gas turbine engine rotor assembly in accordance with claim 17 wherein said rotor blade further comprises at least one first shank opening extending between said channel and said first plenum, and at least one second shank opening extending between said channel and said second plenum.

19. A gas turbine engine rotor assembly in accordance with claim 17 wherein said rotor blade further comprises a first shank opening extending between a first channel and said first plenum and second plenums, and a second shank opening extending between a second channel and said first and second plenums.

20. A gas turbine engine rotor assembly in accordance with claim 16 wherein said first and second plurality of openings are sized to facilitate controlling a quantity of cooling air supplied to the platform upper surface.

* * * * *

UNITED STATES PATENT AND TRADEMARK OFFICE

CERTIFICATE OF CORRECTION

PATENT NO. : 7,131,817 B2
APPLICATION NO. : 10/903634
DATED : November 7, 2006
INVENTOR(S) : Keith et al.

It is certified that error appears in the above-identified patent and that said Letters Patent is hereby corrected as shown below:

In Claim 12, column 7, line 40, delete “between said a” and insert therefor -- between a --.

Signed and Sealed this

Eleventh Day of December, 2007

JON W. DUDAS
*Director of the United States Patent and Trademark Office*